US006479143B1

(12) United States Patent
Tamaru et al.

(10) Patent No.: US 6,479,143 B1
(45) Date of Patent: Nov. 12, 2002

(54) HEAT-MELTABLE FLUORORESIN FIBERS

(75) Inventors: Shinji Tamaru, Settsu (JP); Katsutoshi Yamamoto, Settsu (JP); Jun Asano, Settsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/600,718

(22) PCT Filed: Jan. 14, 1999

(86) PCT No.: PCT/JP99/00107

§ 371 (c)(1),
(2), (4) Date: Jul. 20, 2000

(87) PCT Pub. No.: WO99/36605

PCT Pub. Date: Jul. 22, 1999

(30) Foreign Application Priority Data

Jan. 20, 1998 (JP) ..... 10-8431

(51) Int. Cl.[7] ..... D01F 6/00

(52) U.S. Cl. ..... 428/364; 428/397; 428/394; 428/422

(58) Field of Search ..... 428/364, 400, 428/399, 394, 370, 422, 421

(56) References Cited

U.S. PATENT DOCUMENTS 5,091,252 A * 2/1992 Hruska ..... 428/370
5,562,986 A * 10/1996 Yamamoto et al. ..... 428/364
5,912,077 A * 6/1999 Tamaru et al. ..... 428/364
5,998,022 A * 12/1999 Tamaru et al. ..... 428/400
6,133,165 A * 10/2000 Tamaru et al. ..... 428/364
6,156,681 A * 12/2000 Tamaru et al. ..... 442/383

FOREIGN PATENT DOCUMENTS

JP 2-169017 6/1990 ..... B01D/71/26
JP 8-510763 11/1996 ..... C08J/5/00
JP 9-256217 9/1997 ..... D01F/6/12

OTHER PUBLICATIONS

International Preliminary Examination Report for PCT/JP99/00107 dated Apr. 5, 2000.

* cited by examiner

*Primary Examiner*—Newton Edwards
(74) *Attorney, Agent, or Firm*—Sughrue Mion, PLLC

(57) ABSTRACT

To provide the heat-meltable fluorine-containing resin fiber having excellent intermingling property and various materials for fiber products obtained therefrom. The heat-meltable fluorine-containing resin such as ETFE having a branched structure is used solely or mixed to other fiber such as an electrically conductive fiber to be formed into a non-woven fabric.

11 Claims, No Drawings

HEAT-MELTABLE FLUORORESIN FIBERS

TECHNICAL FIELD

The present invention relates to fibers or mixed fibers of heat-meltable fluorine-containing resin having a branched structure and a non-woven fabric made by using said fibers.

BACKGROUND ART

For making a non-melt-processable fluorine-containing resin represented by polytetrafluoroethylene (PTFE) and a heat-meltable fluorine-containing resin such as tetrafluoroethylene/perfluoro(alkyl vinyl ether) copolymer (PFA) or ethylene/tetrafluoroethylene copolymer (ETFE) into a fiber, a melt-spinning method, an emulsion-spinning method or a method of cutting a film into a fine and long size has been employed. Fluorine-containing resin fibers obtained through those methods are linear fibers having no branch.

However since a surface of the fluorine-containing resin has good lubricity, sufficient intermingling between the fibers cannot be obtained and therefore the fluorine-containing resin is not suitable, for example, as a material for non-woven fabrics.

The present inventors have developed fibers having a branch, loop and crimp and being excellent in intermingling property by a method of tearing and opening a uniaxially stretched PTFE film by a mechanical force and a method of splitting, and have filed patent applications for various forms and uses (WO94/23098, WO96/00807, WO96/10662, WO96/10668, WO97/26135)

However with respect to melt-processable heat-meltable fluorine-containing resin, under the same method and conditions as in PTFE, opening by dividing of a film does not occur in a film feeding direction, only breaking of a film in a stretching direction occurs and the film cannot be split but stretched and torn, though the reason for that is not known. Thus useful fibers having a branched structure could not be obtained.

An object of the present invention is to provide novel heat-meltable fluorine-containing resin fibers having a branched structure and various materials made by using the same.

DISCLOSURE OF INVENTION

Namely the present invention relates to heat-meltable fluorine-containing resin fibers having a branched structure or cotton-like materials, particularly staple fibers, for example, ETFE staple fibers or cotton-like materials.

Also the present invention relates to mixed fibers or cotton-like materials comprising heat-meltable fluorine-containing resin fibers having a branched structure and one or two or more of other fibers, particularly mixed fibers or cotton-like materials, in which other fibers are electrically conductive fibers or fluorine-containing resin fibers containing a photo-degrading catalyst.

Further the present invention relates to a non-woven fabric made by using those fibers or mixed fibers.

BEST MODE FOR CARRYING OUT THE INVENTION

The heat-meltable fluorine-containing resins to which the present invention is applied are, for example, tetrafluoroethyleneperfluoro(alkyl vinyl ether) copolymer (PFA); ethylene-tetrafluoroethylene copolymer (ETFE), tetrafluoroethylene-hexafluoropropylene copolymer (FEP), polychlorotrifluoroethylene (PCTFE), ethylene-chlorotrifluoroethylene copolymer (ECTFE), polyvinylidene fluoride (PVdF), polyvinyl fluoride (PVF), tetrafluoroethylene-hexafluoropropylene-perfluoro(alkyl vinyl ether) copolymer, and the like. Among them, ETFE is preferred from the viewpoint of heat resistance and chemical resistance.

The fibers can be in the form of staple fiber, split yarn or the like. The fibers in those forms having a branched structure are the fibers of the present invention. Among them, fibers in the form of staple fiber are preferred from the viewpoint of intermingling property and mix spinning property.

As a method for producing heat-meltable fluorine-containing resin fibers having a branched structure, there are:

(1) a method for stretching a heat-meltable fluorine-containing resin film, preferably stretching by five times or more and then tearing and opening by a mechanical force, for example with a combing roll or needle blade roll, (2) a method for stretching a heat-meltable fluorine-containing resin film, preferably stretching by five times or more and then splitting the film with a needle blade roll or the like to form a network structure and cutting the linkage in the network structure, and the like method.

As the method (1) of tearing and opening, the method disclosed in, for example, WO94/23098 can be employed. For example, fibers having a branch can be obtained by passing a uniaxially stretched film between a pair of needle blade rolls through pinch rolls, in which at the time of tearing with needle blades, a feeding speed at the pinch rolls and the number of needles embedded on the needle blade rolls and arrangement of the needles are selected optionally. In order to uniaxially stretch a heat-meltable fluorine-containing resin film such as ETFE until the film can be applied to the above-mentioned tearing and opening, the film is uniaxially stretched gradually, namely the stretching step is divided into multi stages. Thus enough stretching can be achieved.

The fibers obtained in the method (1) are staple fibers and usually have the following characteristics.

Branch: At least one branch, preferably two or more branches are present on one fiber (filament). The branch may be in the form of loop.

Crimping: Number of so-called crimps which enhance intermingling property. The number of crimps is preferably from 1 to 15/20 mm fiber length.

Fiber length: 1 to 250 mm

Fineness: 2 to 200 deniers

As the splitting method in the method (2), a method explained, for example, in WO96/00807 in detail can be adopted.

For example, the pinch rolls and needle blade rolls used in the method (1) are synchronized with each other, a density and arrangement of needles embedded on the needle blade rolls are optionally selected and the film is split without tearing and opening to make a split film having a network structure. Then the split film is cut into an optional length in the longitudinal direction and further the linkage in the network structure is cut with an opening machine such as a carding machine.

This method is a method of enabling split yarns to be made into staple fibers. The obtained fibers usually have the following characteristics.

Branch: At least one branch, preferably two or more branches are present on one fiber (filament).

Crimping: The number of crimps is preferably from 1 to 15/20 mm fiber length.

Fiber length: Fiber length can be determined optionally by selecting a cutting length, and is usually from 2 to 200 mm.

Fineness: 2 to 200 deniers

The heat-meltable fluorine-containing resin fibers of the present invention have a branched structure and therefore are excellent in intermingling property. One or two or more heat-meltable fluorine-containing resin fibers or a mixture of those fibers with one or more other fibers are useful as a material for various fiber products.

Examples of the form of material for fiber products are the forms of starting material such as yarn, web and cotton-like material, the forms of product such as woven fabric, knitted fabric, non-woven fabric, multi-layer felt, paper sheet and rope, and the like. Particularly preferred are web, non-woven fabric, multi-layer felt and paper sheet.

As a spinning method, a known processing method with a spinning machine can be adopted.

As a method for making a web, for example, a known method by using a carding machine can be adopted.

As a method for making a cotton-like material, for example, an air-lay method of simply accumulating fibers can be adopted.

A woven fabric can be obtained from known weaving method by using the above-mentioned yarns.

As a method for making a non-woven fabric, known methods, for example, needle punching method, water jet method, thermal bonding method, stitch bonding method, powder bonding method and the like can be employed.

A multi-layer felt can be obtained by overlaying the fibers of the present invention in the form of web, cotton-like material or non-woven fabric on a base fabric comprising a woven fabric or non-woven fabric and then intermingling the base fabric with a web or the like through needle punching method, water jet method or the like. The production method and form of the multi-layer felt are explained in detail in WO97/26135. The heat-meltable fluorine-containing resin fibers of the present invention may be used instead of PTFE fibers described in that publication.

The present invention further can provide a thermal-bonding type non-woven fabric of fluorine-containing resin which could not be obtained in a non-woven fabric of conventional PTFE fibers.

Since PTFE is difficult to be melt-processed, it is obliged to be formed into a non-woven fabric through intermingling by a mechanical force and in some cases, falling of short fibers occurs. For that reason, it has been proposed that a thermo-fusing resin layer is provided on PTFE fibers to make a side-by-side type composite fiber and thermal bonding is carried out between the fibers (WO96/10662).

Since the fluorine-containing resin fibers of the present invention are heat-meltable, thermal-bonding type non-woven fabric can be easily obtained by heating and if necessary, pressing the fibers. As a heating method, known production methods of thermal-bonding type non-woven fabric, for example, heating belt type pressing method, a method of heating by passing hot air, a method of irradiating heat rays such as laser, supersonic bonding method, and the like can be employed.

The heating is carried out at a melting point of the heat-meltable fluorine-containing resin or at a temperature higher than that. Melting points of ETFE, PFA, FEP, PCTFE, ECTFE, PVdF and PVF are about 260° C., 310° C., 270° C., 210° C., 245° C., 170° C. and 200° C., respectively. Pressing conditions may be selected depending on purposes (air permeability, strength, etc.).

In the obtained thermal-bonding type non-woven fabric, a part of fibers is thermal-bonded and the fabric has a property that falling of fibers is difficult to occur as compared with non-woven fabrics obtained through the needle punching method or water jet method.

The present invention relates to the mixed fibers comprising the above-mentioned heat-meltable fluorine-containing resin fibers having a branched structure and one or two or more other resin fibers.

In the present invention, other fibers are one or two or more of inorganic fiber, heat resistant synthetic fiber, other fluorine-containing resin fiber, polyolefin fiber, polyester fiber and natural fiber.

A mixing ratio of the other fibers is from 1 to 99% by weight, preferably from 5 to 95% by weight. When the mixing ratio is less than 1% by weight, the other fibers cannot exhibit properties thereof and tend to become merely impurities. When more than 99% by weight, there is a tendency that properties of the fluorine-containing resin cannot be exhibited.

The reason why the other fibers are used is to produce nonwoven fabrics suitable for final applications by varying properties such as intermingling strength, apparent density, electric conductivity and air permeability of the non-woven fabric.

Examples of the above-mentioned inorganic fiber are, for instance, carbon fiber, glass fiber, metal fiber, asbestos, rock wool, and the like. From the viewpoint of fiber length, carbon fiber, glass fiber and metal fiber are preferred.

Examples of the above-mentioned metal fiber are, for instance, stainless steel fiber, copper fiber, steel fiber, and the like. From the viewpoint of corrosion resistance, stainless steel fiber is preferred.

Examples of the preferred heat resistant synthetic fiber are, for instance, polyphenylene sulfide (PPS) fiber, polyimide (PI) fiber, para-linked type aramid fiber, meta-linked type aramid fiber, phenolic fiber, polyalyrate fiber, carbonated fiber and fluorine-containing resin fiber.

Examples of the fluorine-containing resin fiber are, for instance, PTFE fibers which may have a branch or may not have a branch, and heat-meltable fluorine-containing resin fibers having no branch (ETFE, PFA, FEP, PCTFE, ECTFE, PVdF, PVF, and the like).

Examples of the above-mentioned polyolefin fiber are, for instance, polyethylene fiber, polypropylene fiber, nylon fiber, urethane fiber, and the like. From the viewpoint of chemical resistance, preferred are polyethylene fiber and polypropylene fiber.

Examples of the above-mentioned polyester fiber are, for instance, polyethylene terephthalate fiber, polybutylene terephthalate fiber, and the like. From economical point of view, namely from the viewpoint of production in industrial scale, polyethylene terephthalate fiber is preferred.

Examples of the above-mentioned natural fiber are, for instance, wool, cotton, cashmere, angora rabbit hair, silk, hemp, pulp, and the like. From the viewpoint of fiber length necessary for intermingling property, preferred are wool and cotton.

From functional point of view, there are other fibers such as an electrically conductive material, fluorine-containing resin fiber containing a photo-degrading catalyst, electlet fiber, and the like.

Examples of the electrically conductive material are, for instance, inorganic electrically conductive fibers such as carbon fiber and metal fiber, organic electrically conductive fibers such as polypyrrole fiber and synthetic fiber coated with metal, and the like.

An object of mixing the electrically conductive fiber is to impart electric conductivity to the obtained fiber product, and therefore a mixing amount of the electrically conductive fiber may be optionally selected depending on an intended product. It is preferable to select the amount usually in the range of from about 5% by weight to about 95% by weight on the basis of heat-meltable fluorine-containing resin fiber.

Among the electrically conductive fibers, carbon fiber is preferred from the viewpoint of stability of chemical properties such as chemical resistance.

The fluorine-containing resin fiber containing a photo-degrading catalyst basically comprises a fibrous material obtained from a fluorine-containing resin containing a photo-degrading catalyst. Examples of the fluorine-containing resin are PTFE, PFA, FEP, ETFE, and the like. Among them, PTFE is preferred. Following explanation is made based on PTFE, but the explanation can be applied to other fluorine-containing resins.

PTFE used throughout the present specification encompasses tetrafluoroethylene (TFE) homopolymer and a copolymer of TFE and other comonomer in an amount of up to 0.2%. Non-restricted examples of the comonomer are, for instance, chlorotrifluoroethylene, hexafluoropropylene, perfluoro(alkyl vinyl ether), and the like. As polymerization method, either of emulsion polymerization and suspension polymerization may be employed.

Examples of the photo-degrading catalyst used in the present invention are anatase-type titanium dioxide, zinc oxide, tungsten trioxide, and the like. Those catalysts are usually in the form of powder. Among those photo-degrading catalysts, anatase-type titanium dioxide is particularly preferred from the points that a wide range of malodorous substances, for example, ammonia, acetaldehyde, acetic acid, trimethylamine, methylmercaptan, hydrogen sulfide, styrene, methyl sulfide, dimethyl disulfide, isovaleric acid, and the like can be degraded and that a degrading effect can be exhibited even with weak rays (ultraviolet rays).

The content is not less than 5% by weight. From the viewpoint of easiness of molding, the content is preferably not more than 50% by weight, particularly from 10 to 40% by weight.

Examples of the form of fibers are monofilament, staple fiber, split yarn, finished yarn, and the like.

Examples of the method for making the fluorine-containing resin fiber containing a photo-degrading catalyst are as follows.

(1) Production of Monofilament (A) Production by Emulsion Spinning Method (cf. U.S. Pat. No. 2,772,444)

An aqueous dispersion comprising a fluorine-containing resin powder, photo-degrading catalyst powder, surfactant and coagulant (coagulant is, for example, sodium alginate, or the like which coagulates under acid condition) is extruded through fine nozzles in an acid bath, and a coagulated fibrous extrudate is dried, sintered and stretched to give a monofilament.

(B) Production by Opening a Film (cf. WO94/23098)

(a) Preparation of Starting Powder of Fluorine-containing Resin Containing Titanium Oxide After mixing an aqueous dispersion of fluorine-containing resin powder with an aqueous dispersion of photo-degrading catalyst powder, the mixture is stirred or after the mixing and then adding a coagulant (hydrochloric acid, nitric acid, or the like is added dropwise), the mixture is stirred. Thus at the same time of aggregation of primary particles of the fluorine-containing resin, the photo-degrading catalyst powder is also coagulated and thereby incorporated into the aggregated primary particles of the fluorine-containing resin to give secondary particles (average particle size: 200 to 1,000 $\mu$m), followed by drying to give a powder (a-1).

Also there is a method of preparation by uniformly mixing a fluorine-containing resin powder with a photo-degrading catalyst powder (a-2).

In the method (a) for preparing a starting powder containing a photo-degrading catalyst, the method (a-1) is preferred. In the method (a-1), it is possible that the photo-degrading catalyst is contained in a larger amount (for example, from 10.1 to 40% by weight), and a uniform molded article can be produced from the obtained powder. Also when forming into a fibrous material, the photo-degrading catalyst is dispersed uniformly and good photo-degrading activity can be exhibited. According to that method, the photo-degrading catalyst powder can be contained uniformly in a large amount (for example, more than 30%).

When PTFE is used as the fluorine-containing resin, the following two steps (b) and (c) are carried out.

(b) Production of Un-sintered Film

To the mixed powder obtained in the above (a) is added an extrusion aid (ISOPAR M which is a petroleum solvent and available from Exxon Chemical), and then the powder is made into a film by the method of paste extrusion and calender molding. Further the extrusion aid is dried to give an un-sintered film. As another method for adding a photo-degrading catalyst powder, there is a method for dispersing the powder in the extrusion aid and then mixing to give a powder capable of paste extrusion.

(c) Production of Heat-treated Film (Sintered Film A, Semi-sintered Film B)

The sintered film A can be obtained by heating the unsintered film produced in the above (b) at a temperature of not less than a melting point of PTFE, usually in an atmosphere of 350° to 380° C. for about two minutes or more.

Also the mixed powder obtained in the above (a-2) can be formed into a film by compression-molding the mixed powder to make a cylindrical pre-molded article which is then heated at 360° C. for 15 hours, cooled and cut to give a film.

The semi-sintered film B can be obtained by heat-treating the un-sintered film produced in the above (b) at a temperature between the melting point of the powder (about 345° C. to about 348° C.) and the melting point of a sintered article (325° C. to 328° C.).

As another method for producing a film, there is a method of obtaining a casting film by coating a dispersion of a mixture comprising fluorine-containing resin particles and titanium oxide particles on a fluorine-containing resin film and then sintering or by coating the dispersion on an aluminum plate or the like or polyimide film and then sintering.

In that case, with respect to the fluorine-containing resin particles and film, PTFE is used solely or mixed or combined with PFA and FEP.

When the fluorine-containing resin is a heat-meltable fluorine-containing resin, a film can be produced, for example, by extrusion molding of pellets highly containing titanium oxide (usually called "masterbatch") and high purity fluorine-containing resin pellets with screw.

(d) Production of Stretched Films (C and D)

The stretched film can be obtained by passing a film in the longitudinal direction between the rolls with heating and changing relative speeds of the rolls. The sintered film A can be stretched by about five times (stretched film C) and the semi-sintered film B can be stretched by about 5 times to about 20 times (stretched film D).

(e) To Make a Monofilament

As one method for making a monofilament, the sintered film A or semi-sintered film B is finely cut into pieces and then stretched in the longitudinal direction. Thus the monofilament can be obtained.

As another method, in order to obtain a monofilament having a branch, the stretched film C or D is torn with rotating needle blade rolls. After tearing, dividing may be carried out.

A maximum thickness of the monofilament is determined by a starting film. A minimum thickness is determined by a minimum width of slits and is about 25 Tex.

(2) Production of Staple Fiber (cf. WO94/23098) Staple fibers can be produced by cutting the above-mentioned monofilaments to an optional length (preferred length is from about 25 mm to about 150 mm). In order to enhance intermingling property of fibers and increase a surface area thereof with thinner fibers, it is preferable to use staple fibers having a branch. The staple fibers having a branch can be obtained by tearing the stretched film C or D with needle blade rolls rotating at high speed.

Those staple fibers have a branch and crimp and can be used solely or in the form of finished yarn mentioned hereinafter.

Non-restricted examples of preferable characteristics of the staple fibers obtained by the above method are mentioned below.

Fiber length: 5 to 200 mm, preferably 10 to 150 mm

Number of branches: 0 to 20 branches/5 cm, preferably 0 to 10 branches/5 cm

Number of crimps: 0 to 25 crimps/20 mm, preferably 1 to 15 crimps/20 mm

Fineness: 1 to 150 deniers, preferably 2 to 75 deniers

Sectional shape: Irregular (3) Production of Split Yarn (WO95/00807)

Split yarns can be produced by firstly slitting the uniaxially stretched film C or D obtained in the above (d) of (1)-(B) into a ribbon form having a width of about 5 mm to about 20 mm and then splitting by using a needle blade roll, preferably a pair of needle blade rolls.

Network structure means that the uniaxially stretched film split with the needle blades of needle blade rolls is not formed into separate fibers and shows net-like form when enlarged in the widthwise direction (a direction at a right angle to the film feeding direction).

The split yarn can be woven or knitted solely or in a bundle of two or more thereof or in the form of finished yarn mentioned hereinafter.

(4) Production of Finished Yarn

The finished yarn is produced by combining the fluorine-containing resin fibrous material containing a photo-degrading catalyst which was obtained in the above (1), (2) or (3) with other fibrous material.

Mix spinning and blending by twisting can be carried out by usual method.

Examples of the other fibrous material are fibrous activated carbon; natural fiber materials such as cotton and wool; semi-synthetic fiber materials such as rayon; synthetic fiber materials such as polyester, nylon and polypropylene; and the like. Fibrous activated carbon, etc. are preferable as a deodorizing anti-bacterial cloth used when odor becomes strong rapidly (when gas concentration becomes high). Examples of the fibrous activated carbon are, for instance, those produced from acrylic fiber, and the like. It is preferable that an amount of the fluorine-containing resin fiber containing a photo-degrading catalyst is not less than 10%, particularly not less than 20% on the basis of the finished yarn from a point of exhibiting deodorizing anti-bacterial activity.

By mixing the fluorine-containing resin fiber containing a photo-degrading catalyst, a deodorizing activity or anti-bacterial activity can be imparted to the mixed fiber and fiber products obtained therefrom. Further it is preferable to make an adsorbing agent having a deodorizing activity exist in various forms in order to enhance deodorizing efficiency. Examples of the adsorbing agent having a deodorizing activity are an activated carbon, zeolite, ASTENCH C-150 (available from Daiwa Kagaku Kogyo Kabushiki Kaisha), and the like in the form of fiber or particle.

Among those adsorbing agents, when particles of activated carbon or zeolite are contained in PTFE in the form of a filler, a content thereof is not more than 25%, preferably from 1 to 20% on the basis of PTFE.

In case of such an adsorbing agent as ASTENCH C-150, it can be coated on or impregnated in the other fibrous material of the above-mentioned finished yarn or other fibrous material to be used when forming into a cloth. As a method for coating or impregnating ASTENCH C-150, it is preferable to coat an about 10% aqueous solution of ASTENCH C-150 by usual method such as dipping method or spraying method and then dehydrating and drying.

Also as mentioned above, the fibrous activated carbon having a deodorizing activity can be used as one of the other fibrous materials for the finished yarn. In that case, it is preferable that a content thereof is not more than 80%, particularly from 5 to 75% on the basis of the finished yarn.

The mixed fiber of the present invention comprising the heat-meltable fluorine-containing resin fiber having a branched structure and the fluorine-containing resin fiber containing a photo-degrading catalyst functions so that the photo-degrading catalyst exhibits deodorizing anti-bacterial activity effectively. The mixed fiber is made into the form of woven fabric, knitted fabric, non-woven fabric, and the like and is useful, for example, as a deodorizing antibacterial cloth.

Such a deodorizing anti-bacterial cloth may be in the multi-layered form in combination with a base fabric of other fibrous material. When the base fabric is used, it may be in any form of woven fabric, non-woven fabric and knitted fabric. Examples of a preferred material thereof are a fibrous activated carbon, meta-linked type aramid fiber, para-linked type aramid fiber, PTFE fiber, polyimide fiber, glass fiber, polyphenylene sulfide fiber, polyester fiber, and the like. Particularly in order to enhance a deodorizing effect, it is preferable that the base fabric contains a fibrous activated carbon. A content of the fibrous activated carbon in the base fabric is from 5 to 100%, preferably from about 10% to about 100%.

The so-produced material comprising the fluorine-containing resin fiber containing a photo-degrading catalyst is used as it is or processed into a desired form, and can be used as a filler for various materials and also for applications such as carpet, cover for illumination, reflection plate, cloth for interior, blind, curtain, roll curtain, bedclothes (bed cover, pillow cover, etc.), shoji screen paper, wall paper, tatami-mat, window screen, air filter, filter for air conditioner, liquid filter, interior materials of vehicles (automobile, train, aircraft, ship, etc.), net lace, medical clothes (clothes for operation, etc.), medical gloves (surgery glove, etc.), curtain for bath, paper diaper, slippers, shoes (school shoes, nurse shoes, etc.), phone cover, sterilizing filter for 24-hour bath, foliage plant (artificial flower), fishing net, clothes, socks, bag filter, and the like. Particularly the deodorizing anti-bacterial cloth can be used as materials for diaper cover and apron, bedding materials such as bed, mat, pillow and sheet, decorating materials such as curtain, table cloth, mat and wall cloth. Further among those applications, the deodorizing antibacterial cloth is useful where an offensive smell is developed and propagation of bacteria easily occurs such as hospital, toilet, cooking room and dressing room.

As a method for producing the mixed fiber, in addition to the method for feeding two or more fibers into an opening machine and carding machine, in case where other fiber can be produced through tearing and opening of a film (for example, uniaxially stretched PTFE film), a method for overlapping a uniaxially stretched film of heat-meltable fluorine-containing resin and other resin film and then carrying out tearing and opening of the films simultaneously can be adopted. Also in that case, a fibrillated material such as carbon fiber may be used together.

Important features of the present invention are that intermingling property can be enhanced by letting the fiber have branches and thus a web and non-woven fabric can be produced easily and in addition, since a heat-meltable fluorine-containing resin is used as the fluorine-containing resin, a thermal-bonding type non-woven fabric can be produced using the fluorine-containing resin as a thermo-fusing component. It is a matter of course that for the other fiber, heat-meltable resins, for example, PE, PP, polyamide, polyester and vinyl chloride which have a melting point lower than that of the heat-meltable fluorine-containing resin can be used as a thermo-fusing component. Non-woven fabrics produced by combination use of fluorine-containing resins or combination use of the fluorine-containing resin with an inorganic fiber (carbon fiber, metal fiber, etc.) are highly needed from the viewpoint of heat resistance and chemical resistance.

When the heat-meltable fluorine-containing resin fiber is used as a thermo-fusing component of a thermal-bonding type non-woven fabric, other fiber is a fiber comprising a material having a melting point higher than that of the heat-meltable fluorine-containing resin.

For example, there are PTFE (melting point: about 326° C.), carbon fiber, stainless steel fiber and glass fiber and in addition, there are, for example, polyimide fiber, para-linked type amide fiber, and the like which are not decomposed even if exposed to a temperature of not less than a melting point of PTFE for a short period of time. Also in case of combination use of heat-meltable fluorine-containing resin fibers, the fiber having a lower melting point is a thermo-fusing component. For example, when ETFE (melting point: about 260° C.) fiber is used, PFA (melting point: about 310° C.), FEP (melting point: about 270° C.), and the like are used as the other fiber.

Examples of preferred combination of component fibers of the mixed fiber of the present invention are as follows.

(1) (A) Heat-meltable Fluorine-containing Resin Fiber

Each fiber of ETFE, PFA, FEP, PCTFE, ECTFE, PVdF, PVF, or the like.

(B) Other Fiber

One or two or more of fluorine-containing resin fiber, electrically conductive fiber, fluorine-containing resin fiber containing photo-degrading catalyst and heat resistant synthetic fiber.

(2) (A) Heat-meltable Fluorine-containing Resin Fiber

Each fiber of ETFE, PVdF, or the like.

(B) Other Fiber

Heat-meltable fluorine-containing resin fiber except those of (A), PTFE fiber, carbon fiber, metal fiber, PTFE fiber containing photo-degrading catalyst, polyimide fiber, para-linked type aramide fiber, meta-linked type aramide fiber, PPS fiber, or the like.

Further there are (3) (A) ETFE fiber and (B) other fluorine-containing resin (PTFE, PFA, FEP, or the like) fiber.

(4) (A) ETFE fiber and (B) electrically conductive fiber (carbon fiber, stainless steel fiber, or the like).

(5) (A) ETFE fiber and (B) PTFE fiber containing photo-degrading catalyst.

(6) (A) ETFE fiber and (B) other fluorine-containing resin fiber and electrically conductive fiber.

(7) (A) ETFE fiber and (B) PTFE fiber and carbon fiber.

(8) (A) ETFE fiber and (B) PTFE fiber containing photo-degrading catalyst and other fluorine-containing resin fiber. The preferred combinations are not limited to those mentioned above.

Examples of various fiber materials and fiber products which are produced by the heat-meltable fluorine-containing resin fibers and mixed fibers of the present invention are, for instance, as follows. Fiber materials:

Yarn, cotton-like material, web, woven fabric, knitted fabric, non-woven fabric, multi-layered felt and rope. Fiber products:

1̂ Dust-collecting cloth: For example, a non-woven fabric comprising ETFE fiber and PTFE fiber having a branch.

2̂ Deodorizing anti-bacterial cloth: For example, a woven fabric or non-woven fabric comprising ETFE fiber and PTFE fiber containing photo-degrading catalyst.

3̂ Electromagnetic wave shielding sheet: For example, a paper-like sheet comprising ETFE fiber, PTFE fiber and stainless steel fiber. This sheet is useful for electronic devices to be located where there is a fear of exposure to high temperature.

Other applications of the fibers of the present invention are as follows.

(Application for Office Automation)

In the form of sheet (web), non-woven fabric, woven fabric and various molded articles: Examples of the product are, for instance, toner sealing member, releasing agent feeding member and toner blade for printer, copying machine, etc.

(Application for Air Filter)

In the form of sheet (web), non-woven fabric, woven fabric and various molded articles: Examples of the product are, for instance, mold type filter, electret filter, filter for high temperature gas, filter for air conditioner for car, adsorbing material, filter for air cleaner, filter for ventilator, filter for vacuum cleaner and bag filter.

(Application for Liquid Filter)

In the form of sheet (web), non-woven fabric, woven fabric and various molded articles: Examples of the product are, for instance, water tank filter, filter press, winder filter, cartridge filter, filter cloth for liquid, filter for water-purifier tank, filter for water purifier and engine oil filter.

(Application for Covering Material)

In the form of sheet (web), non-woven fabric, woven fabric and various molded articles: Examples of the product are, for instance, iron cover, cover for steam iron stand, electric carpet cover, radar sight cover, antenna cover, electromagnetic wave shielding material, fluorescent lamp cover, light scattering filter for illumination.

(Application for Sealing Material and Sliding Material)

In the form of sheet (web), non-woven fabric, woven fabric, knitted cord and various molded articles: Examples of the product are, for instance, tape for window frame, gland packing, stern tube seal, magnetic tape press felt, sliding material for sill, sliding material for furniture and wind stabilizer.

(Printed Circuit Board)

In the form of sheet (web), non-woven fabric, woven fabric and various molded articles: Examples of the product are, for instance, printed circuit board and cushion for press for printed circuit board.

(Application for Belt)

In the form of sheet (web), non-woven fabric, woven fabric and various molded articles: Examples of the product are, for instance, belt for paper making and transfer belt.

(Thread, Yarn)

Split yarn and filament having a branch: Examples of the product are, for instance, sewing thread, dental floss and rope.

(Application for Special Clothes)

Sheet (web), non-woven fabric and woven fabric: Examples of the product are, for instance, heat resistant gloves, fireman's cloth, acid-proof cloth, operating gown, bulletproof jacket and dust-free cloth.

(Application for Water-repellent Cloth)

In the form of sheet (web), non-woven fabric, woven fabric and various molded articles: Examples of the product are, for instance, sheet for incontinence, socks, table cloth, swimsuits, curtain, carpet, covering material for wound, bandage, supporter, gloves, raincoat, umbrella, mat cover, bedquilt cover, sheets, material for shoes, insoles for footwear and slippers.

(Application for Wiring)

In the form of sheet (web), non-woven fabric, woven fabric and various molded articles: Examples of the product are, for instance, insulating material for cord, flat cable covering material, separator for battery electrodes and non-woven fabric for prepreg.

(Application for Building Material)

In the form of sheet (web), non-woven fabric, woven fabric and various molded articles: Sound-proof and sound-absorbing sheet and various filters.

(Application for Sound-proofing and Sound Absorbing)

In the form of sheet (web), non-woven fabric, woven fabric and various molded articles: Sound-proof and sound-absorbing cover and sheet for various apparatuses.

Then the present invention is explained by means of examples and comparative examples, but is not limited to them.

EXAMPLE 1

A device for tearing and opening which is described in WO94/23098 was used.

A staple fiber having a branched structure was obtained by tearing and opening of a uniaxially stretched ETFE film (15 $\mu$m thick×50 mm wide film produced by stretching a 30 $\mu$m thick×100 mm wide film in the longitudinal direction at two stages firstly by 4 times and then secondly by 2.5 times, in total by 10 times with a pair of 250 mm diameter rolls heated to 200° C.) with needle blade rolls (diameter of roll at needle tip: 50 mm, outer diameter of roll: 45 mm, pitch of needles on circumference of roll: divided equally into 60 parts, length of roll at the needle-planted part: 250 mm, number of needles in the longitudinal direction: 325) rotating at high speed (peripheral speed ratio to pinch rolls: 30 times) through pinch rolls. The staple fibers subjected to tearing and opening were accumulated through an air duct on a travelling mesh belt below the duct to give a web having a unit weight of 150 g/m$^2$.

Then the web was nipped with rolls (clearance between the rolls was set at 0.3 mm) heated to 300° C. to give a sheet.

In the sheet, fibers were formed into continuous fibers thermally bonded with each other at contacting points thereof.

EXAMPLE 2

Material A (20 $\mu$m thick×75 mm wide uniaxially stretched PTFE film obtained by stretching 15 times in the longitudinal direction), material B (15 $\mu$m thick×50 mm wide uniaxially stretched ETFE film obtained by stretching 10 times in the longitudinal direction) and material C (carbon fiber (TOREKA available from Toray Industries Inc.)) were subjected to tearing and opening in a weight ratio of 30% of A, 20% of B and 50% of C with needle blade rolls (diameter of roll at needle tip: 50 mm, outer diameter of roll: 45 mm, pitch of needles on circumference of roll: divided equally into 60 parts, length of roll at the needle-planted part: 250 mm, number of needles in the longitudinal direction: 325) rotating at high speed (peripheral speed ratio to pinch rolls: 30 times) through pinch rolls. Thus a web having a unit weight of 250 g/m$^2$ and comprising mixed materials A, B and C was obtained.

Then the web was nipped with two metal plates (clearance gauge: 0.1 mm) heated to 300° C. and pressed at 5 kg/cm$^2$ for two minutes to give a sheet. Physical properties of the sheet were as follows.

(Physical Properties of Sheet)

Unit weight: 250 g/m$^2$

Thickness: 110 $\mu$m

Porosity: 65% (A 5 cm square sample sheet is used. When a calculated volume of the sample is assumed to be $V_1$ and an actual volume measured by dipping the sample in isopropanol is assumed to be $V_2$, a porosity of the sample is calculated by $(V_1-V_2)/V_1\times100$ (%)).

Air permeability: 10 cc/cm$^2$/sec (measured by Frazier method)

Volume resistance in a direction of thickness: 150 Ω·cm (measured by using a 1 cm square electrode)

Volume resistance in a direction of surface: 0.2 Ω·cm (measured at 1 cm width×5 cm distance)

90° bending test: A sheet of 1 cm wide is bent by hand along a right angle corner of a jig. The sheet was not broken and there was no change in volume resistance.

Comparative Example 1

A web was produced in the same manner as in Example 2 except that the material B (ETFE film) was wholly changed to PTFE. The web was formed into a sheet by changing a temperature of the heated metal plates from 300° C. to 380° C., but no thermal bonding occurred between the fibers.

Reference Example 1

(1) Preparation of Starting PTFE Powder Containing Titanium Oxide

A 10% aqueous dispersion containing 8 kg of emulsion polymerized PTFE particles (number average molecular weight: 5,000,000, average particle size: about 0.3 $\mu$m) and a 20% aqueous dispersion containing 2 kg of anatase type titanium dioxide (Titanium Dioxide P25 available from Nippon Aerosil Co., Ltd., average particle size: about 21

μm) were poured continuously into a coagulation tank (capacity: 150 liters, inside temperature: 30° C.) provided with stirring blades and temperature control jacket, followed by stirring to give a secondary particles in which the PTFE particles and titanium dioxide particles were agglomerated uniformly. Then those secondary particles were separated from water phase. Those agglomerated particles were dried in an oven (130° C.) to give PTFE powder (average particle size: 500 μm, apparent density: about 450 g/liter) containing titanium dioxide in an amount of 20%.

(2) Production of Un-sintered Film

To the PTFE powder containing titanium dioxide which was obtained in above (1) was mixed a molding aid (petroleum solvent ISOPAR M available from Exxon Chemical) in an amount of 25 parts on the basis of 100 parts of PTFE powder to give a paste. The paste was extruded through paste extrusion method and rolled with rollers. Then the molding aid was removed by drying to give a continuous un-sintered PTFE film containing titanium dioxide of 200 mm wide×100 μm thick.

(3) Production of Heat-treated Film

The un-sintered PTFE film containing titanium dioxide of above (2) was heat-treated to give a sintered PTFE film A-1 containing titanium dioxide and a semi-sintered PTFE film B-1 containing titanium dioxide The sintered PTFE film A-1 was obtained by heating the unsintered PTFE film in an oven of 360° C. for about three minutes.

The semi-sintered PTFE film B-1 was obtained by heating the un-sintered PTFE film in an oven of 340° C. for about 30 seconds. A degree of sintering (crystalline conversion) of the obtained film was 0.4.

(4) Production of Uniaxially Stretched Film

The sintered PTFE film A-1 was stretched by 5 times in the longitudinal direction with two pairs of heat rolls (diameter: 330 mm, temperature: 300° C.) to give a uniaxially stretched film C-1.

Also the semi-sintered PTFE film B-1 was stretched by 10 times in the longitudinal direction by using the above-mentioned heat rolls to give a uniaxially stretched film D-1.

The uniaxially stretched film can be utilized as it is since the titanium dioxide particles are exposed on the surface of the film dislike the un-stretched film. Further when the film is formed into a fiber as mentioned below, more preferred characteristics and application forms can be provided.

(5) Production of Monofilament

By slitting the sintered PTFE film A-1 and semi-sintered PTFE film B-1 of above (3) into a width of 2 mm and then uniaxially stretching them in the same manner as in above (4), a monofilament of 200 Tex having a rectangular section and a monofilament of 100 Tex having a rectangular section were obtained from the film A-1 and the film B-1, respectively.

Besides the method of (6) below, a staple fiber can be obtained by cutting those monofilaments short.

(6) Production of Staple Fiber

The uniaxially stretched film C-1 or D-1 obtained in above (4) was subjected to tearing and opening according to the method of Example 5-(4) of WO94/23098 by using a pair of upper and lower needle blade rolls at a film feeding speed (V3) of 1.6 m/min at a peripheral speed (V4) of needle blade rolls of 48 m/min to give PTFE staple fibers containing titanium dioxide. Each of staple fibers is a filament having a ranch.

Industrial Applicability

According to the present invention, heat-meltable fluorine-containing resin fibers being excellent in intermingling property can be provided, and particularly thermal-bonding type fluorine-containing resin materials for fiber product such as non-woven fabric which have various functions can be provided.

What is claimed is:

1. A melt-processable heat-meltable fluorine-containing resin fiber having a branched structure, wherein the fluorine-containing resin constituting the melt-processable heat-meltable fluorine-containing resin fiber is selected from the group consisting of ethylene-tetrafluoroethylene copolymer, tetrafluoroethylene-perfluoro(alkyl vinyl ether) copolymer, tetrafluoroethylene-hexafluoropropylene copolymer, ethylene-chlorotrifluoroethylene copolymer, poly (vinylidene fluoride) and poly(vinyl fluoride), and said fiber is a fiber selected from the group consisting of a monofilament, staple fiber, split yarn and finished yarn.

2. A mixed fiber comprising the heat-meltable fluorine-containing resin fiber of any of claims 1 and one or two or more of other fibers.

3. The mixed fiber of claim 2, wherein said other fiber is an electrically conductive fiber.

4. The mixed fiber of claim 2, wherein said other fiber is a fluorine-containing resin fiber containing a photo-degrading catalyst.

5. A cotton-like material comprising the heat-meltable fluorine-containing resin fiber of claim 1 and one or more other fibers.

6. A non-woven fabric comprising the heat-meltable fluorine-containing resin fiber of claim 1 and one or more other fibers.

7. The non-woven fabric of claim 6, wherein a part or the whole of heat-meltable fluorine-containing resin fibers are subjected to thermal-bonding.

8. The cotton-like material of claim 5, wherein the other fiber is an electrically conductive fiber.

9. The cotton-like material of claim 5, wherein the other fiber is a fluorine-containing resin fiber containing a photo-degrading catalyst.

10. The non-woven fabric of claim 6, wherein the other fiber is an electrically conductive fiber.

11. The non-woven fabric of claim 6, wherein the other fiber is a fluorine-containing resin fiber containing a photo-degrading catalyst.

* * * * *